US005080692A

United States Patent [19]

Lee et al.

[11] Patent Number: 5,080,692

[45] Date of Patent: Jan. 14, 1992

[54] EXTRACTION OF ORGANIC SULFUR FROM COAL BY USE OF SUPERCRITICAL FLUIDS

[75] Inventors: Sunggyu Lee; Sunil K. Kesavan, both of Akron; Vetkav R. Parameswaran, University Heights, all of Ohio

[73] Assignee: The University of Akron, Akron, Ohio

[21] Appl. No.: 435,569

[22] Filed: Nov. 13, 1989

[51] Int. Cl.[5] ..... C10L 9/02

[52] U.S. Cl. ..... 44/624

[58] Field of Search ..... 44/622, 624, 625, 626

[56] References Cited

U.S. PATENT DOCUMENTS

| | | | |
|---|---|---|---|
| 3,660,054 | 5/1972 | Rieve | 44/624 |
| 4,053,285 | 10/1977 | Robinson | 44/622 |
| 4,192,651 | 3/1980 | Keller | 44/622 |
| 4,441,886 | 4/1984 | Muchmore et al. | 44/626 |

FOREIGN PATENT DOCUMENTS

| | | | |
|---|---|---|---|
| 2127432 | 4/1984 | United Kingdom | 44/624 |

*Primary Examiner*—Carl F. Dees
*Attorney, Agent, or Firm*—Oldham & Oldham Co.

[57] ABSTRACT

Organic sulfur is removed from coal by extraction with a water/methanol/carbon dioxide mixture under supercritical conditions of temperature and pressure, i.e., at a temperature and pressure of the critical temperature and pressure, respectively. The preferred solvent used for extraction has the following composition (expressed as a mole fraction);

| | |
|---|---|
| Carbon Dioxide | from 0 to 0.30 |
| Methanol | from 0.20 to 0.70 |
| Water | from 0.20 to 0.70 |

Preferably, the mole fraction carbon dioxide is at least 0.05 and mole fraction of water is not greater than 0.65. Either fixed bed (semi-batch) or mixed reactor systems can be used. Operations may be carried out in a single stage using a solvent of constant composition, or it may be carried out in plural stages in which the critical temperature of the solvent used in each stage (except the first) is higher than that of the solvent used in the preceding stage. Overall molar quantities of solvent used in plural stage operations are in accordance with the mole fractions given above. A substantial amount of the total organic sulfur present is removed.

14 Claims, 2 Drawing Sheets

EXTRACTION OF ORGANIC SULFUR FROM COAL BY USE OF SUPERCRITICAL FLUIDS

TECHNICAL FIELD

This invention relates to processes for upgrading of coal by removal of organic sulfur therefrom. More particularly, this invention relates to processes for removal of organic sulfur from coal by use of supercritical fluids.

BACKGROUND ART

Most of the world's electricity is generated by combustion of a fossil fuel. Coal, oil (petroleum) and natural gas are all used for this purpose. From the standpoint of both economics and conservation, conversion from petroleum and natural gas to coal would be desirable. Known reserves of both petroleum and natural gas are dwindling, while abundant coal reserves remain, particularly in the United States.

Conversion from oil and natural gas to coal is hampered in many states of the United States by the high sulfur content in the coal supply. This sulfur, on combustion, forms sulfur oxides ($SO_x$), which are atmospheric pollutants. Legal limits on SOx emissions have been established, and these promise to become more stringent in the future.

$SO_x$ emission specifications can be met by either desulfurizing the coal before combustion (pretreatment), by development of combustion techniques or additives that minimize SOx generation (concurrent treatment), or by scrubbing the stack gases (post treatment). Among these three emission control techniques, pretreatment has been proven to be the most economically and technically viable approach.

Physical cleaning methods presently being employed to remove sulfur from coal remove a large portion of the inorganic sulfur (mostly pyritic), but leave the organic sulfur untouched. Organic sulfur constitutes about one-half of the total sulfur in most high sulfur coals and, hence, economically viable chemical methods are needed to reduce organic sulfur content.

Supercritical extraction of coal has been previously described. "Supercritical extraction" herein refers to extraction of coal with one or more solvents at a temperature and pressure above the critical temperature and pressure, respectively (usually just above the critical temperature and pressure) of the solvent. For example, U.S. Pat. No. 3,988,238 describes desulfurization of coal by contacting the coal with water and optionally a co-solvent, which may be methanol, at a temperature either above or below the critical temperature. Amounts of co-solvent, when used, are small, and solvent-to-coal ratios are large (the water-to-coal ratio being at least 2:3 and preferably at least 1:1).

Prior attempts at supercritical extraction of coal have resulted in either the liquefaction of coal or substantial removal of organic coal components through conversion into liquid and gaseous components.

DISCLOSURE OF THE INVENTION

The process described herein for the removal of organic sulfur from coal results in efficient extraction of a large portion of the total organic sulfur present. Unlike prior supercritical coal treatment techniques, the present process preferentially removes a large fraction of the sulfur compound without significant loss of volatiles or other organic species.

The present invention provides a process for removal of organic sulfur from a carbonaceous material containing the same, said process comprises contacting the carbonaceous material with methanol, water and optionally carbon dioxide under supercritical conditions of temperature and pressure, the mole fractions of carbon dioxide, methanol, and water, all based on the combined amounts of said carbon dioxide, methanol and water, being as follows:

| | |
|---|---|
| Carbon Dioxide | from 0 to 0.30 |
| Methanol | from 0.20 to 0.70 |
| Water | from 0.20 to 0.70 |

The carbonaceous material being treated is preferably coal.

BRIEF DESCRIPTION OF THE DRAWINGS IN THE DRAWINGS

BEST MODE FOR CARRYING OUT THE INVENTION

Figure 1:
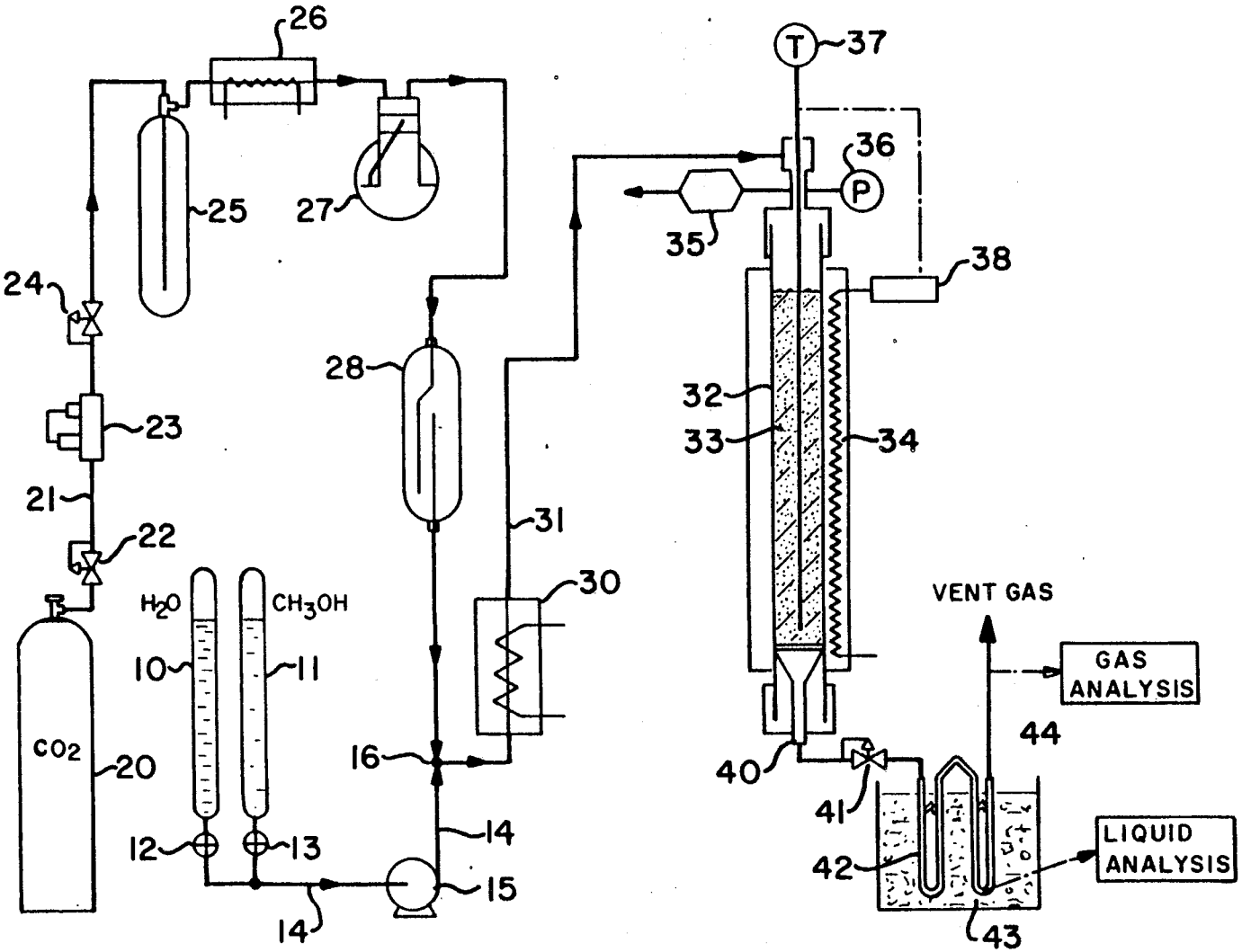
FIG. 1 is a schematic diagram of an apparatus including a fixed bed extractor for extracting sulfur from coal in accordance with a first embodiment of the present invention.

The present invention is suitable for removal of sulfur from any carbonaceous material, having an unacceptably high organic sulfur content in its "as is" state. Some organic sulfur (i.e., chemically combined sulfur in the form of organic compounds) is present. Other elements may also be present. Typically the carbonaceous material is a fuel. A fuel may be either solid, e.g. coal, or liquid, e.g. crude oil or heavy ends. Preferably, the carbonaceous material is a solid, and most preferably, is coal. This invention will be described with particular reference to the treatment of coal.

The coal or other solid material must be in finely divided form. Broadly, all of the solid particles should be finer than 180 mesh (Tyler). Typically, coal having a particle size distribution of 80 weight percent through 200 Tyler mesh and 20 weight percent of $-180+200$ Tyler mesh is used.

The treating agent or solvent comprises methanol, water, and optionally, carbon dioxide. Carbon dioxide is preferably used in addition to methanol and water. The composition of the treating solvent, on a mole fraction basis (the total quantity of treating solvent being 1.0 mole) is as follows:

| | |
|---|---|
| Carbon Dioxide | from 0 to 0.30 |
| Methanol | from 0.20 to 0.70 |
| Water | from 0.20 to 0.70 |

The preferred treating solvent composition, expressed as mole fractions (again based on the total quantity of solvent as 1.0 mole) are follows:

| | |
|---|---|
| Carbon Dioxide | from 0.05 to 0.25 |
| Methanol | from 0.30 to 0.50 |
| Water | from 0.25 to 0.65 |

The treating solvent may contain additional treating fluids besides carbon dioxide, methanol and water, but usually it does not. In other words, the treating solvent preferably consists essentially of methanol, water, and optionally carbon dioxide. When the compounds are the only treating fluids used, the mole fractions given above are based on the combined quantities of carbon dioxide, methanol and water.

The coal is contacted with treating solvent under supercritical conditions of temperature and pressure. The term, "supercritical conditions of temperature and pressure," refers to a temperature above the critical temperature (Tc) of the solvent being used, and a pressure above the critical pressure (Pc) of the solvent being used. The treatment temperature is usually from 470° to 630° K. All temperatures herein will be given in degrees Kelvin (° K) unless otherwise stated. Treatment according to this invention is carried out at a reduced temperature (Tr) from 1.0 to about 1.4, preferably from about 1.05 to about 1.3, and at a reduced pressure (pr) from 1.0 to about 2.0, preferably from about 1.05 to about 1.5.

The solvent-to-coal ratio for treatment according to this invention is from about 0.2 to about 3 kilograms of solvent per kilogram of coal (Kg/Kg) preferably from about 0.3 to about 1.0 Kg/Kg. Actually, the solvent-to-coal ratio is a dimensionless number, since both the amount of solvent and the amount of coal are expressed on a weight basis.

The present invention makes possible the use of much lower solvent to coal ratio than those used in prior art processes at the lower end of the solvent to coal range.

The solvent flow rate is from about 0.2 to 3 kilograms per hour of solvent per kilogram of coal per hour (i.e. 0.2 to 3 kg/kg-hr). Preferably the solvent flow rate is about 0.5 kg/kg-hr. The time of treatment may range from about 0.5 to about two hours, and is preferably about one hour.

The coal may be treated in either a single stage or in plural stages (i.e., in two or more stages). In single stage extraction or treatment, the composition of the treating solvent remains uniform over the entire course of treatment, and is as given earlier. In plural stage treatment, the composition of the treating solvent is typically varied during the course of treatment. Preferably in plural stage treatment, the critical temperature of the treating solvent used in each stage increases progressively. Thus, the first stage solvent may be a mixture of carbon dioxide and water, or carbon dioxide and methanol; the solvent for the next stage may be, for example, a mixture of methanol and water with no carbon dioxide. In an extreme case, the coal may be contacted consecutively with each of the treating fluids, i.e., first with carbon dioxide, then with methanol, and finally with water, each in pure or substantially pure form. Whenever the composition of the solvent is varied over the course of treatment, the overall solvent composition (based on the total quantities of each treating fluid used over the entire course of treatment) is as stated above, i.e., the mole fraction of carbon dioxide is from 0 to 0.5 (preferably 0.05 to 0.25), the mole fraction of methanol is from 0.20 to 0.70 (preferably 0.30 to 0.50), and the mole fraction of water is from 0.20 to 0.70 (preferably 0.25 to 0.65).

Either a fixed bed or a moving bed reactor may be used for extraction of organic sulfur from coal or other carbonaceous solid material in accordance with this invention. Both will be described in detail hereinafter. When the carbonaceous material is a liquid at treatment temperature, a conventional stirred reactor can be used as extraction equipment.

This invention will be further described with reference to the drawings. This description will be with reference to preferred embodiments, i.e., those wherein the carbonaceous material is coal in finely divided state, and wherein a single treatment stage, employing a solvent of uniform composition throughout the course of treatment, is used.

Referring now to FIG. 1, pure water and pure methanol are contained in liquid form in feed reservoirs 10 and 11, respectively, having exit flow control valves 12 and 13, respectively. Liquid water and liquid methanol are introduced from reservoirs 10 and 11, respectively, into liquid feed line 14. The water/methanol mixture is pumped through feed line 14 by means of a high pressure duplex reciprocating piston pump 15. This water/methanol mixture flows to mixing tee 16.

Carbon dioxide is stored as a liquid under pressure in pressure vessel 20, which may be a conventional gas cylinder. Carbon dioxide is withdrawn as a gas or vapor from container 20 into gas line 21. Carbon dioxide flow from container 20 is controlled by pressure regulator 22. The feed rate of carbon dioxide through line 21 to the extractor is controlled by the use of a mass flow controller 23 and a control valve 24. Carbon dioxide is then passed through a pulse suppressor 25 and a feed preheater 26 to insure smooth flow of the carbon dioxide stream to gas compressor 27. Carbon dioxide is compressed in gas compressor 27 and the flow of compressed carbon dioxide is stabilized by passing it through flow stabilizer 28. The carbon dioxide stream flows from stabilizer 28 to mixing tee 16.

The carbon dioxide stream is mixed with the methanol/water mixture in mixing tee 16. The combined mixture is pre-heated in feed pre-heater 30 to a temperature close to but slightly below the reaction temperature. Heated solvent mixture is then fed via solvent feed line 31 to extractor 32, which has a fixed or stationary coal bed 33 therein. The coal in fixed bed 33 is finely divided, typically finer than 180 mesh (Tyler).

Extractor 32 is a vertical tubular reactor, which is surrounded by a heating jacket having an electric heater 34 therein. A foraminous plate at the bottom of reactor 32 supports the coal bed 33. Extractor 32 is provided with a rupture disc 35 and a pressure gauge 36. Extractor 32 is also provided with a temperature indicator 37, which indicates the temperature in coal bed 33, and a temperature controller 38, which control the current to electric heater 34 in response to the temperature as sensed by temperature indicator 37.

The solvent is maintained under supercritical conditions of temperature and pressure as it passes downwardly through coal bed 33. The solvent exiting the reactor 32, which contains organic sulfur and other organic compounds, is throttled by means of a control valve 41, which may be a needle valve. The normally liquid components of the solvent mixture, i.e., water, methanol, organic sulfur compounds and other normally liquid organics, are condensed by passage through a tubular condenser 42. Condenser 42 is cooled by any suitable means such as a dry ice-acetone bath 43. Condensed liquids may be removed periodically (e.g. at the end of a run) from condenser 42 for analysis. Uncondensed gases, typically carbon dioxide and normally gaseous hydrocarbons, are vented from condenser 42 through vent line 44. These gases may be analyzed as desired. The calorific value of the vent gases in line 44 may be recovered, e.g., by combustion of the gas mixture, where the calorific value is sufficient to justify this.

According to a preferred procedure, finely divided coal is charged to the reactor 32 prior to the start of a run. Water, methanol and carbon dioxide are fed to the reactor 32 in desired proportions. The respective feed rates are controlled by means of valves 12 and 13 and mass flow controller 23. The solvent feed mixture is pre-heated in pre-heater 30 to a temperature just below the critical temperature. The solvent mixture is passed downwardly through the coal bed 33 in reactor 32, where it is maintained under supercritical conditions of temperature and pressure by means of external heat supplied from electric heater 34. The solvent exit mixture containing organic sulfur compounds and other organics is continuously removed and is condensed as previously described. A run is allowed to proceed either for a predetermined length of time or for a length of time determined by some other parameter, such as instantaneous sulfur analysis. Normally the solvent composition, i.e. the relative amounts of water, methanol and carbon dioxide, will remain constant throughout a run. This mode of operation may be described as semi-batch, since the coal is charged to and discharged from extractor 32 before and after a run, respectively, in accordance with batch operation principles, while the solvent mixture is fed continuously throughout a run.

Semi-batch operation as described in FIG. 1 may be carried out in two or more stages, using solvents of different composition in each stage. The solvent in each stage may be either a single fluid (carbon dioxide, methanol or water) or a mixture of any desired composition. Valves 12 and 13 and flow controller 23 make it possible for the operator to pass solvent of any desired composition into extractor 32. When more than one stage is used, the first stage (the earliest portion of the run) typically uses the most volatile solvent (i.e. the solvent having the lowest critical temperature), and the solvent or solvent mixtures used in subsequent operating stages have progressively higher critical temperatures.

In place of coal, other finely divided carbonaceous solids containing organic sulfur compounds may be desulfurized in extractor 32. When the organic sulfur-containing carbonaceous material to be desulfurized is a liquid at operating temperatures (i.e. temperatures under which the solvent mixture is under supercritical conditions), suitable extractors, such as a stirred high pressure reactor, will be substituted for the extractor 32, and the solvent mixture under supercritical conditions will be passed through the extractor.

Coal or other organic sulfur-containing carbonaceous solid may also be desulfurized continuously, as will now be described with respect to FIGS. 2 and 3.

Figure 2:
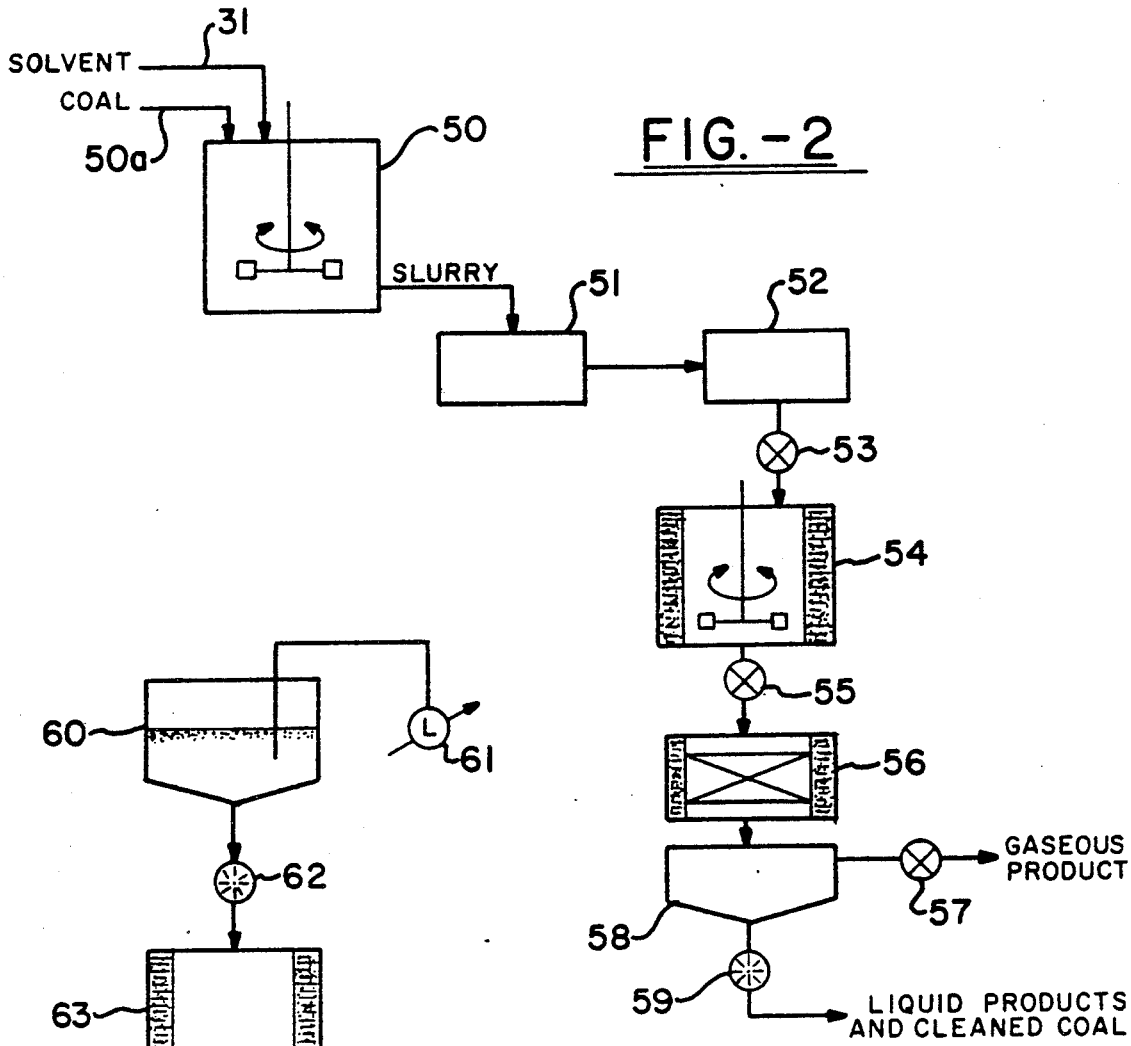
FIG. 2 is a schematic diagram of an apparatus including a continuous extractor for extracting sulfur from coal in accordance with the second embodiment of this invention.

Referring now to FIG. 2, vessel 50 is a stirred high-pressure vessel which serves to mix up a slurry of coal with solvent. Powdered coal and mixed supercritical extraction solvent are fed to vessel 50 via coal feed line **50*a* and solvent feed line 31, respectively. The solvent entering through line 31 is a mixed solvent consisting essentially of carbon dioxide, methanol and water, which may be prepared as described with reference to FIG. 1. The resulting coal/solvent slurry is next pumped by a high-pressure slurry pump 51 through a feed preheater 52, which serves to heat up the mixture to a temperature just below the extraction temperature. The preheated feed is then admitted through a ball valve 53 into a supercritical extractor 54 which is of the stirred reactor design. The mixture of coal and extracting solvent containing the extracted sulfur is passed through discharge valve 55 into a product cooler 56. The cooled product is next sent to a separating vessel 58 in which the gaseous product of extraction are separated from the cleaned coal and the liquid products. The gaseous product is then vented from the system through valve 57. The solid and liquid products are removed through valved discharge line 59**.

Figure 3:
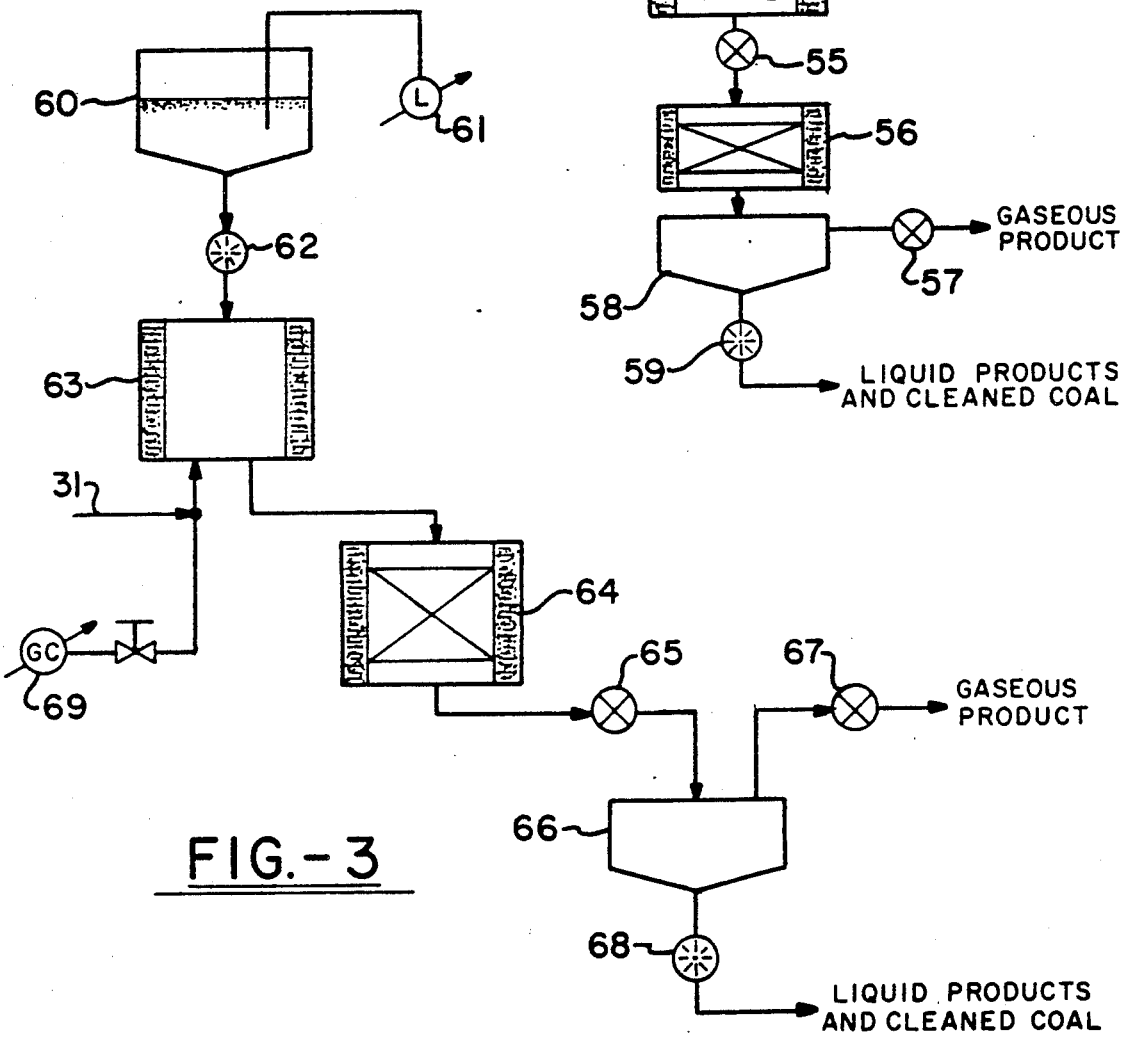
FIG. 3 is a schematic diagram of an apparatus for continuous extraction of organic sulfur from coal in accordance with a third embodiment of this invention.

FIG. 3 shows another configuration for continuous supercritical extraction. Herein, powdered coal is contained in storage hopper 60. Level control in hopper 60 is achieved through use of a solid level indicator-controller 61. Powdered coal is metered from storage hopper 60 through a rotary air lock feeder 62 into supercritical extractor 63. A solvent mixture is fed into the supercritical extractor 63. This solvent mixture is a pressurized mixture of carbon dioxide, methanol and water which may be formed, pressurized and preheated to just below the critical temperature as described with reference to FIG. 1. The solvent mixture can be analyzed for composition using a gas chromatograph 69. The system shown in FIG. 3 differs from that shown in FIG. 2 in that the system of FIG. 2 can be operated only co-currently, while the system of FIG. 3 can be operated either counter-currently or cocurrently. A mixture of extract and cleaned coal discharged from the supercritical extractor 63 is cooled in product cooler 64 before being let down through valve 65 into product separating vessel 66. In this vessel, the gaseous products of extraction are separated from the cleaned coal and the liquid products. The gaseous product is then vented from the system through valve 67. The cleaned coal and liquid products are discharged through valve 68.

This invention will now be described further with reference to the example which follows.

EXAMPLE I

An Ohio 5/6 coal sample is crushed, ground and blended to produce a size distribution of 80 weight percent; −200 Tyler mesh, 20 weight percent, −180+200 Tyler mesh. 15 grams of this coal was extracted with a water/methanol/carbon dioxide mixture of mole ratio 4:4:2. Extraction temperature and autogenous pressure were maintained at 556° K and 17 MPa respectively for two hours. This process removes 61 percent of organic sulfur and 38.3 percent of total sulfur. The proximate and ultimate analysis of the coal before and after extraction are given in Table I.

TABLE I

| | (values are in wt %) | | | | |
|---|---|---|---|---|---|
| Coal | C | H | N | S | O |
| Original | 69.37 | 5.40 | 1.76 | 3.21 | 20.26 |
| Extracted | 73.52 | 4.96 | 1.43 | 1.98 | 18.11 |

| Coal | Volatiles | Ash | Fixed Carbon | Btu/lb |
|---|---|---|---|---|
| Original | 40.68 | 8.13 | 51.19 | 11997 |
| Extracted | 34.96 | 8.58 | 56.46 | 12481 |

| | Forms of Sulfur (values in wt %) | |
|---|---|---|
| | Original Coal | Extracted Coal |

TABLE I-continued

| | | |
|---|---|---|
| Total Sulfur | 3.21 | 1.98 |
| Sulfate sulfur | 0.22 | 0.17 |
| Pyritic sulfur | 1.27 | 1.14 |
| Organic sulfur | 1.72 | 0.67 |

EXAMPLE 2

Fifteen grams of a coal sample having the analysis shown above is charged to a fixed bed extractor as shown in FIG. 1, and is extracted with carbon dioxide/-methanol/water mixtures of various compositions as shown hereinafter in Table 2. Variables in this series of experiments are mole fractions of methanol and carbon dioxide, and extraction temperature (° K) and pressure (atmospheres). Mole fractions of water (which are not shown in Table 2) can be determined by difference, since the only feed ingredients are carbon dioxide, methanol and water. Thus, the mole fractions of these three ingredients always add up to 1. All temperatures and pressures used in this example are in the supercritical range. All tests in this example are of one hour in duration.

Each sample was weighed and analyzed for organic sulfur content (wt. percent organic sulfur) before and after the test in order to determine the percentage of organic sulfur removed. The percentage of organic sulfur removed is based on the original organic sulfur content. Results are shown in Table II below:

TABLE II

| Sample # | Run # | Mole Fraction $CH_3OH$ | Mole Fraction $CO_2$ | T, °K. | P, atm | Wt. % org. S removed |
|---|---|---|---|---|---|---|
| 1 | 1 | 0.35 | 0.10 | 575 | 200 | 45.07 |
| 2 | 2 | 0.45 | 0.10 | 575 | 200 | 41.65 |
| 3 | 15 | 0.35 | 0.20 | 575 | 200 | 36.52 |
| 4 | 11 | 0.45 | 0.20 | 575 | 200 | 36.02 |
| 5 | 23 | 0.35 | 0.10 | 595 | 200 | 56.35 |
| 6 | 3 | 0.45 | 0.10 | 595 | 200 | 54.05 |
| 7 | 13 | 0.35 | 0.20 | 595 | 200 | 49.87 |
| 8 | 20 | 0.45 | 0.20 | 595 | 200 | 46.20 |
| 9 | 8 | 0.35 | 0.10 | 575 | 220 | 37.92 |
| 10 | 17 | 0.45 | 0.10 | 575 | 220 | 42.73 |
| 11 | 4 | 0.35 | 0.20 | 575 | 220 | 43.28 |
| 12 | 19 | 0.45 | 0.20 | 575 | 220 | 37.45 |
| 13 | 24 | 0.35 | 0.10 | 595 | 200 | 60.43 |
| 14 | 5 | 0.45 | 0.10 | 595 | 220 | 49.51 |
| 15 | 22 | 0.35 | 0.20 | 595 | 220 | 52.48 |
| 16 | 10 | 0.45 | 0.20 | 595 | 220 | 57.24 |
| 17 | 6 | 0.40 | 0.15 | 585 | 210 | 44.22 |
| 18 | 12 | 0.40 | 0.15 | 585 | 210 | 47.10 |
| 19 | 18 | 0.40 | 0.15 | 585 | 210 | 40.25 |
| 20 | 28 | 0.40 | 0.15 | 585 | 210 | 40.77 |
| 21 | 29 | 0.40 | 0.15 | 585 | 210 | 43.13 |
| 22 | 25 | 0.30 | 0.15 | 585 | 210 | 42.72 |
| 23 | 7 | 0.50 | 0.15 | 585 | 210 | 47.40 |
| 24 | 14 | 0.40 | 0.05 | 585 | 210 | 51.57 |
| 25 | 26 | 0.40 | 0.25 | 585 | 210 | 42.84 |
| 26 | 9 | 0.40 | 0.15 | 565 | 210 | 27.54 |
| 27 | 27 | 0.40 | 0.15 | 605 | 210 | 53.68 |
| 28 | 16 | 0.40 | 0.15 | 585 | 190 | 42.84 |
| 29 | 21 | 0.40 | 0.15 | 585 | 230 | 45.41 |

In the above table, "org. S" refers to organic sulfur.

Only organic sulfur and a small amount of pyritic sulfur are removed by the process of this invention. However, efficient methods of removing pyritic sulfur are known in the art, as previously explained. Based on the analysis shown in Table II, organic sulfur removal varies from 27.54 weight percent (in sample 26) to 60.43 weight percent (in sample 13).

Based on the data shown in Table II, the coordinates to the stationary point (the point denoting a solvent composition where the sulfur extraction is maximum) were determined from a regression equation and were found to be:

| | |
|---|---|
| mole fraction of methanol | 0.496 |
| mole fraction of $CO_2$ | 0.0765 |
| extraction temperature | 640.3° K. |
| extraction pressure | 225.3 atm |

The present invention provides a highly efficient process for the extraction of organic sulfur from high sulfur coal. The same techniques can be applied to the extraction of other high sulfur carbonaceous material, both liquid and solid, in which the principle elements present on the dry basis are carbon and hydrogen. Removal of organic sulfur from coal according to the present invention, coupled with removal of pyritic sulfur from the coal by known means, results in the obtaining a coal of sufficiently low sulfur content as to be acceptable for fuel (e.g. in an electric power plant) from a coal whose original sulfur content is so high that it would be unsuitable for such combustion because of the resultant sulfur dioxide pollution.

Use of ternary water/methanol/carbon dioxide mixtures according to this invention, permits one to extract a large fraction of the organic sulfur present while keeping the process conditions reasonable and minimizing loss of calorific value of the fuel. Use of pure water or a solvent having a high concentration of water (e.g. above about 75 mole percent) is undesirable since the resulting solvent mixture removes a large amount of volatiles in the coal (resulting in a loss of fuel value) and produces a large amount of tar. This phenomenon is due to the relatively high critical temperature and pressure of water. Formation of tars and release of volatile materials from coal are normally considered to be negative in coal processing, because of the loss in heating value as well as operational difficulties. Methanol is too costly to be used as the sole supercritical solvent in an economically viable process. Carbon dioxide alone is not an efficient extractant. Binary water/methanol solvent mixtures can be used for extraction; however, ternary carbon dioxide/methanol/water mixtures give more efficient sulfur removal and make lower operating pressures and temperatures possible. Also, addition of methanol and carbon dioxide to water reduces the average molecular size of the solvent and thus improves access to the micropores in the coal. Additionally, methanol and carbon dioxide have a high affinity for the coal's surface. Thus, the present process provides an efficient method for removing organic sulfur from the coal, which is not realized by using any one of the solvents alone and which is not fully realized with binary mixtures of any two of the three solvents used herein.

While in accordance with the patent statutes the best mode and preferred embodiment of the invention has been described, it is to be understood that the invention is not limited thereto, but rather is to be measured by the scope and spirit of the appended claims.

What is claimed is:

1. A process for removing organic sulfur from coal which comprises contacting said coal with methanol, water and optionally carbon dioxide under supercritical conditions of temperature and pressure, the mole fractions of carbon dioxide, methanol and water, being as follows:

| | |
|---|---|
| Carbon Dioxide | from 0 to 0.30 |
| Methanol | from 0.20 to 0.70 |
| Water | from 0.20 to 0.70 |

2. A process according to claim 1 in which said coal is contacted with said carbon dioxide and the respective mole fractions of said carbon dioxide, said methanol and said water are as follows:

| | |
|---|---|
| Carbon Dioxide | from 0.05 to 0.25 |
| Methanol | from 0.30 to 0.50 |
| Water | from 0.25 to 0.65. |

3. A process according to claim 1 in which said coal is contacted concurrently with said methanol, said water and optionally said carbon dioxide, said methanol, said water and said carbon dioxide when present being in the form of a mixture which is at a supercritical temperature and pressure.

4. A process according to claim 1 in which said coal is contacted consecutively in at least two stages with supercritical fluids each consisting essentially of carbon dioxide, methanol, water or a mixture thereof.

5. A process according to claim 4 in which the supercritical fluid in each stage except the first has a higher critical temperature than the supercritical fluid in the preceding stage.

6. A process according to claim 4 in which said coal is contacted consecutively in separate stages with carbon dioxide, methanol and water in the order named.

7. A process according to claim 1 in which the reduced temperature is not greater than about 1.4.

8. A process according to claim 7 in which the reduced temperature is from 1.05 to 1.3.

9. A process according to claim 1 in which the reduced pressure is not over about 2.

10. A process according to claim 9 in which the reduced pressure is from 1.05 to 1.5.

11. A process according to claim 1 in which the operating temperature is from 470° to 630° K.

12. A process according to claim 1 in which the operating pressure is from 75 to 250 atmospheres.

13. A process according to claim 1 in which the weight ratio of supercritical fluid to coal is from 0.2 to 3, said supercritical fluid being said combined amounts of said carbon dioxide when used, said methanol and said water.

14. A process according to claim 13 in which the weight ratio of supercritical fluid to coal is from 0.3 to 1.

* * * * *